US007932192B2

(12) United States Patent
Fujisawa et al.

(10) Patent No.: US 7,932,192 B2
(45) **Date of Patent: *Apr. 26, 2011**

(54) BASE FOR SYNTHETIC LEATHER AND SYNTHETIC LEATHERS MADE BY USING THE SAME

(75) Inventors: Michinori Fujisawa, Okayama (JP); Jiro Tanaka, Okayama (JP); Tsuyoshi Yamasaki, Okayama (JP); Norio Makiyama, Okayama (JP); Yoshiyuki Ando, Okayama (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 221 days.

This patent is subject to a terminal disclaimer.

(21) Appl. No.: 12/097,659

(22) PCT Filed: Dec. 13, 2006

(86) PCT No.: PCT/JP2006/324812

§ 371 (c)(1),
(2), (4) Date: Jul. 3, 2008

(87) PCT Pub. No.: WO2007/069628

PCT Pub. Date: Jun. 21, 2007

(65) Prior Publication Data

US 2009/0053948 A1 Feb. 26, 2009

(30) Foreign Application Priority Data

Dec. 14, 2005 (JP) ..... 2005-360884

(51) Int. Cl.
*B32B 27/02* (2006.01)
*D01F 8/00* (2006.01)

(52) U.S. Cl. ..... 442/164; 442/340; 442/402; 442/408; 428/904; 264/172.13

(58) Field of Classification Search ..... 442/164, 442/340, 408, 402; 428/904; 264/172.13
See application file for complete search history.

(56) References Cited

U.S. PATENT DOCUMENTS

| | | | | |
|---|---|---|---|---|
| 6,716,776 | B2 * | 4/2004 | Morishima et al. | 442/104 |
| 2007/0231547 | A1 * | 10/2007 | Makimura et al. | 428/151 |

FOREIGN PATENT DOCUMENTS

| | | | |
|---|---|---|---|
| EP | 0 651 090 | A1 | 5/1995 |
| EP | 1 541 750 | A2 | 6/2005 |
| EP | 1 550 767 | A1 | 7/2005 |
| EP | 1 930 495 | A1 | 6/2008 |
| JP | 53 34903 | | 3/1978 |
| JP | 57 154468 | | 9/1982 |
| JP | 7 173778 | | 7/1995 |
| JP | 11 200219 | | 7/1999 |
| JP | 2000 110060 | | 4/2000 |
| JP | 2000 273769 | | 10/2000 |
| JP | 2002 275748 | | 9/2002 |
| JP | 2003 328276 | | 11/2003 |
| WO | WO 2005-106108 | A1 * | 11/2005 |

OTHER PUBLICATIONS

U.S. Appl. No. 12/302,813, filed Dec. 1, 2008, Fujisawa, et al.
U.S. Appl. No. 11/917,665, filed Dec. 14, 2007, Fujisawa, et al.
U.S. Appl. No. 12/161,013, filed Jul. 16, 2008, Fujisawa, et al.
U.S. Appl. No. 12/593,399, filed Sep. 28, 2009, Tanaka, et al.

* cited by examiner

*Primary Examiner* — Norca L Torres-Velazquez
(74) *Attorney, Agent, or Firm* — Oblon, Spivak, McClelland, Maier & Neustadt, L.L.P.

(57) ABSTRACT

A substrate for artificial leathers, comprising a nonwoven fabric body made of microfine fiber bundles and an elastic polymer impregnated therein. The substrate for artificial leathers simultaneously satisfies the following requirements 1 to 4: (1) each of the microfine fiber bundles contains 6 to 150 bundled microfine long fibers in average; (2) a cross-sectional area of the microfine long fibers constituting the microfine fiber bundles is 27 $\mu m^2$ or less, and 80% or more of the microfine long fibers has a cross-sectional area of from 0.9 to 25 $\mu m^2$; (3) an average cross-sectional area of the microfine fiber bundles is from 15 to 150 $\mu m^2$; and (4) on a cross section parallel to a thickness direction of the nonwoven fabric body, cross sections of the microfine fiber bundles exist in a density of from 1000 to 3000/$mm^2$ in average. The raised artificial leathers and grain-finished artificial leathers made from the substrate for artificial leathers are excellent in the properties which are hitherto difficult to be combined.

11 Claims, No Drawings

BASE FOR SYNTHETIC LEATHER AND SYNTHETIC LEATHERS MADE BY USING THE SAME

This application is a 371 of PCT/JP2006/324812, filed Dec. 13, 2006.

TECHNICAL FIELD

The present invention relates to a substrate for artificial leathers. By using the substrate for artificial leathers, raised artificial leathers combining a highly dense and elegant raised appearance, a good color development, a good surface abrasion resistance such as pilling resistance and a soft hand with fullness, and grain-finished artificial leathers combining a highly smooth surface with fine buckling grains, a high bonding/peeling strength and a soft hand with a full feeling are obtained.

BACKGROUND ART

Raised artificial leathers such as suede finished artificial leathers and nubuck artificial leathers which have a raised surface made of the fiber bundles on a substrate comprising fiber bundles and an elastic polymer have been known. The raised artificial leathers are required to fully satisfy a high level of physical properties such as fastness to light, pilling resistance and abrasion resistance, in addition to sensuous properties such as appearance (surface feeling closely resembling natural leathers), hand (soft touch combined with a moderate fullness and a dense feeling), and color development (brilliantness and depth of color). To meet such requirements, there have been made various proposals.

To meet the requirement on the appearance and hand, for example, it has been generally employed to make artificial leathers from microfine fibers. In the production of the artificial leathers made of microfine fibers, it has been widely used to convert composite fibers such as sea-island fibers and multi-layered fibers to microfine fiber bundles by splitting or removal of a polymer component by decomposition or extraction. The raised artificial leathers and grain-finished artificial leathers, which are made from a substrate for artificial leather comprising a nonwoven fabric of microfine fiber bundles resulted from the composite fibers and an elastic polymer impregnated into the nonwoven fabric, are rated highly in their appearance and hand. However, such artificial leathers involve a problem of lowering the color development as the fiber fineness is decreased, to cause a remarkable deterioration in the brilliantness and depth of color. Particularly, the raised artificial leathers fail to meet a general requirement for high quality.

The nonwoven fabric body for the substrate for artificial leathers is generally produced by a method which includes a step of cutting spun fibers into staple fibers having a length of 100 mm or less, a step of making the staple fibers into a nonwoven web having a desired mass per unit area by a carding or paper-making method, a step of optionally superposing two or more nonwoven webs, and a step of entangling the fibers by a needle-punching or spun-lacing method. Using the nonwoven fabric body having a desired bulkiness and a degree of entanglement thus produced, the substrate for artificial leathers is produced. The raised artificial leathers and grain-finished artificial leathers produced from such a substrate for artificial leathers are highly rated particularly in their hand. Although the staple fibers constituting the nonwoven fabric body are fixed in the substrate by the entanglement between fibers and the impregnated elastic polymer, the staple fibers on the raised surface of raised artificial leathers or in the interface between the substrate and the grain layer of grain-finished artificial leathers unavoidably tend to be easily pulled out or fallen from the nonwoven fabric body because of their short length. With this tendency, the important surface properties such as the abrasion resistance of raised surface and the bonding/peeling strength of grain layer are reduced. To remove this problem, there have been generally employed to increase the degree of entanglement, bond the fibers with each other, or impregnate an elastic polymer in a large amount so as to strongly bind the fibers. However, the increase in the degree of entanglement and the use of an increased amount of elastic polymer in turn remarkably deteriorate the hand of artificial leathers. Thus, it is difficult to satisfy the requirements for the appearance, hand and surface properties simultaneously.

To improve the surface abrasion resistance of raised artificial leathers, typically the pilling resistance of raised fibers, there has been proposed to produce suede-finished artificial leathers by a method including a step of making a nonwoven fabric from sea-island fibers which are capable of being converted into bundles of microfine fibers of 0.8 D or less; a step of entangling the nonwoven fabric by needle punching; a step of immersing the entangled nonwoven fabric in an aqueous solution of polyvinyl alcohol (PVA) and then drying it to temporally fix the shape of the nonwoven fabric; a step of removing the sea component from the sea-island fibers by extraction using an organic solvent; a step of impregnating a solution of polyurethane in dimethylformamide (DMF) and coagulating the polyurethane; and a step of raising the surface (Patent Document 1). It is also proposed to add coarse particles to the microfine fibers, the coarse particles having a particle size lager than a quarter of the fiber diameter and being inert to the fibers.

In Patent Document 2, it is proposed to produce suede-finished artificial leathers by entangling a nonwoven fabric of sea-island fibers by needle punching; impregnating a solution of polyurethane in DMF into the entangled nonwoven fabric and coagulating the polyurethane; removing the sea component by extraction to obtain a leather-like substrate; and raising the obtained leather-like substrate. The fiber bundles constituting the substrate comprise fine fibers A of 0.02 to 0.2 D and microfine fibers B having a fineness of not more than ⅕ of the average fineness of the fine fibers A and less than 0.02 D. The ratio of the numbers of fibers (A/B) in fiber bundles is 2/1 to 2/3. The inside of fiber bundles is substantially free from an elastic polymer. The ratio of the number of fine fibers A and the number of the microfine fibers B (A/B) in the raised fibers is 3/1 or more.

There has been further proposed a method of improving the pilling resistance of suede-finished artificial leathers, in which the foot of raised fibers is anchored by partially dissolving the elastic polymer around the foot of raised fibers using a solvent (Patent Document 3).

Patent Document 4 proposes a method of producing a long-fiber nonwoven fabric which is capable of being converted into nubuck artificial leathers having a surface touch with fine texture. In the proposed method, the strain, which is characteristic of a long-fiber nonwoven fabric and caused during the entangling treatment, is relieved by intentionally cutting the long fibers during the entangling treatment by needle punching, thereby exposing the cut ends of fibers to the surface of nonwoven fabric in a density of 5 to 100 $\mu mm^2$. It is also proposed to regulate the number of fiber bundles within 5 to 70 per 1 cm width on the cross section parallel to the thickness direction of nonwoven fabric, i.e., regulate the number of fiber bundles which are oriented by needle punching toward the thickness direction within 5 to 70 per 1 cm width. It is further proposed to regulate the total area of fiber bundles on a cross section perpendicular to the thickness direction of nonwoven fabric within 5 to 70% of the cross-sectional area.

Patent Document 5 proposes an entangled nonwoven fabric made of long fibers which are capable of being converted into microfine fibers of 0.5 D or less, in which the percentage crimp of long fibers is 10% or less and the nonwoven fabric contains the fibers in a density of 0.25 to 0.50 g/cm$^3$.

In the method of Patent Document 1, since the solution of polyurethane in DMF is impregnated and coagulated after removing the sea component of the sea-island fibers by extraction, the polyurethane penetrates into the inside of microfine fiber bundles, thereby making the hand hard. In addition, a soft hand and touch are not obtained because the coarse particles are added to the fibers.

In the method of Patent Document 2, since the solution of polyurethane in DMF is impregnated and coagulated before removing the sea component of sea-island fibers by extraction, the microfine fiber bundles are substantially free from the polyurethane on their outer surface and in their inside. Therefore, a soft hand and touch are obtained. However, since the microfine fiber bundles are not fixed together by polyurethane, the pilling resistance is insufficient.

Patent Document 3 merely teaches to anchor the foot of raised fibers by partially dissolving the elastic polymer on the outermost surface of the leather-like substrate. Therefore, the fibers in the leather-like substrate are less fixed and the elastic polymer holds the fibers weakly. Therefore, the proposed method is not effective for improving the pilling resistance when the fineness is 0.01 D or more.

In the method of Patent Document 4 for obtaining the long-fiber nonwoven fabric body, the long fibers are cut while preventing the properties from being made lower than intended. However, since a large number of long fibers are actually cut, the advantages of long fibers that the strength of nonwoven fabric is enhanced because of their continuity are significantly reduced, thereby failing to effectively use their advantages. In Patent Document 4, the entangling treatment is not employed for entangling the long fibers from the surface of long-fiber nonwoven fabric, through the inside thereof, to the opposite surface, but employed for cutting the fibers on the surface of nonwoven fabric evenly to produce an extremely large number of cut ends as many as 5 to 100/mm$^2$. Therefore, the entangling treatment should be performed by needle punching under conditions far severer than generally used. In addition, since the fibers to be entangled for the production of the long-fiber nonwoven fabric body are, like known staple fibers, extremely thick fibers of 2.8 D or more, the long fibers cannot be entangled and compacted sufficiently, thereby failing to obtain high-grade nubuck artificial leathers aimed in the present invention.

Although the method of Patent Document 5 improves the denseness, a substrate for artificial leather impregnated with an elastic polymer having a soft hand cannot be obtained because of a high existence density of fibers.

[Patent Document 1] JP 53-34903A (pages 3 and 4)
[Patent Document 2] JP 7-173778A (pages 1 and 2)
[Patent Document 3] JP 57-154468A (pages 1 and 2)
[Patent Document 4] JP 2000-273769A (pages 3 to 5)
[Patent Document 5] JP 11-200219A (pages 2 and 3)

DISCLOSURE OF THE INVENTION

It has been hitherto difficult to provide a raised artificial leather which simultaneously combines an elegant and dense raised appearance and a color development of raised microfine fibers; a soft fullness and a dense feeling; or a soft touch of the surface having raised microfine fibers and a surface abrasion resistance such as piling resistance. In the grain-finished artificial leathers, it has been difficult to simultaneously combine the balance between a grain layer and a substrate, for example, the balance between hard properties for creating a highly smooth surface with fine buckling grains and soft properties for creating uniformity with a highly soft substrate; a grain layer with a soft fullness and dense feeling and a hand of substrate; or a soft hand due to a high softness of substrate and surface mechanical properties such as a bonding/peeling strength at the grain layer-substrate interface.

An object of the present invention is to provide a substrate for artificial leathers combining the sensuous properties and the physical properties each in a high degree, although these properties are hitherto recognized as antinomic in the art of substrate for artificial leathers. Using the substrate of the present invention, artificial leathers combining a higher quality and higher properties than ever achieved are obtained.

Since the properties mentioned above are combined at high degree, the artificial leathers produced from the substrate of the present invention are suitable as materials for clothes such as jackets, skirts, shirts and coats; shoes such as sport shoes, men's shoes and women's shoes; accessories of dress such as belts; bags such as handbags and school backpacks; furniture such as sofas and office chairs; seats and inner trims for vehicles such as cars, trains, airplanes and ships; sport gloves such as golf gloves, batting gloves and baseball gloves; and other gloves such as driving gloves and work gloves.

As a result of extensive study in view of achieving the above object, the inventors have reached the present invention. Namely, the present invention relates to a substrate for artificial leathers, comprising a nonwoven fabric body made of microfine fiber bundles and an elastic polymer impregnated therein, which simultaneously satisfies the following requirements 1 to 4:

(1) each of the microfine fiber bundles contains 6 to 150 bundled microfine long fibers in average;

(2) a cross-sectional area of the microfine long fibers constituting the microfine fiber bundles is 27 μm$^2$ or less, and 80% or more of the microfine long fibers has a cross-sectional area of from 0.9 to 25 μm$^2$;

(3) an average cross-sectional area of the microfine fiber bundles is from 15 to 150 μm$^2$; and (4) on a cross section parallel to a thickness direction of the nonwoven fabric body, cross sections of the microfine fiber bundles exist in a density of from 1000 to 3000/mm$^2$ in average.

The present invention further relates to a method of producing a substrate for artificial leathers, which comprises the following steps (a), (b), (c) and (d) in this order or the following steps of (a), (b), (d) and (c) in this order:

(a) melt-spinning sea-island fibers having an average island number of 6 to 150, a ratio of an average sea cross-sectional area and an average island cross-sectional area of 5:95 to 70:30, and an average cross-sectional area of 30 to 180 μm$^2$, and then, collecting the sea-island fibers in random directions on a collecting surface without cutting, thereby obtaining a long fiber web;

(b) entangling the sea-island fibers three-dimensionally by needle-punching the long fiber web from both surfaces thereof so as to allow at least one barb to penetrate through the long fiber web optionally after superposing two or more long fiber webs, and then, optionally shrinking or heat-pressing the needle-punched long fiber web for densification and/or fixation, thereby obtaining a nonwoven fabric body in which cross sections of the sea-island fibers exist on a cross section parallel to a thickness direction of the nonwoven fabric body in a density of from 600 to 4000/mm$^2$ in average;

(c) impregnating a solution of an elastic polymer into the nonwoven fabric body and coagulating the elastic polymer by a wet method; and (d) removing a sea component polymer from the sea-island fibers constituting the nonwoven fabric body by extraction or decomposition, thereby converting the sea-island fibers to microfine fiber bundles.

Since the microfine fiber bundles are compacted together more closely than ever known, the substrate for artificial leathers of the present invention is extremely highly densified and has an extremely smooth surface. By using such a substrate for artificial leathers, it is possible to produce raised artificial leathers having a smooth, elegant appearance and touch which are equal to and competitive with those of natural leathers and also being excellent in the color development, hand with fullness and surface abrasion resistance such as pilling resistance. It is also possible to produce grain-finished artificial leathers having a smooth, soft hand with fullness which is equal to and competitive with that of natural leathers and an excellent surface strength such as the bonding/peeling strength.

BEST MODE FOR CARRYING OUT THE INVENTION

The substrate for artificial leathers of the present invention is produced, for example, by carrying out the following steps in the order of (a), (b), (c) and (d) or (a), (b), (d) and (c).

Step (a)

The sea-island fibers are melt-spun by extruding a sea component polymer and an island component polymer from a composite-spinning spinneret.

The composite-spinning spinneret preferably has a structure having arrays of nozzles, which are disposed in parallel. In each array, the nozzles are arranged in a straight row. With such a structure, the cross section in which 6 to 150 islands of the island component polymer in average are dispersed in the sea component polymer is obtained.

The sea component polymer and the island component polymer are extruded from the spinneret at a spinneret temperature of from 180 to 350° C. while regulating the relative feeding amounts of the polymers and the feeding pressure such that the average area ratio (i.e., volume ratio of the polymers) of the sea component polymer and the island component polymer on the cross section of the fibers being produced falls within a range of from 5/95 to 70/30.

The average cross-sectional area of the sea-island fibers is from 30 to 180 μm$^2$. The average single fiber fineness is preferably from 0.3 to 1.8 dtex and more preferably from 0.5 to 1.7 dtex when the island component polymer is nylon 6 and the sea component polymer is polyethylene, although depending upon the area ratio of the polymers to be made into a composite. In the present invention, the long fiber means a fiber longer than a short fiber generally having a length of about 3 to 80 mm and a fiber not intentionally cut as so done in the production of short fibers. For example, the length of the long fibers before converted to microfine fibers is preferably 100 mm or longer, and may be several meters, hundreds of meter, or several kilo-meters as long as being technically possible to produce or being not physically broken.

The melt-spun sea-island fibers are collected on a collecting surface such as net in random directions without cutting, thereby producing a long fiber web having a desired mass per unit area (preferably from 10 to 1000 g/m$^2$).

Step (b)

The long fiber web thus obtained, optionally after superposing two or more long fiber webs by a crosslapper, is then needle-punched from both surfaces thereof simultaneously or alternately so as to allow at least one barb to penetrate through the long fiber web, thereby three-dimensionally entangling the fibers. Thus, a nonwoven fabric body in which the sea-island fibers exist on a cross section parallel to the thickness direction of the nonwoven fabric body in a density of from 600 to 4000/mm$^2$ in average, and the sea-island long fibers are extremely closely compacted is obtained. An oil agent may be added to the long fiber web at any stage after its production and before the entangling treatment.

A further densified entanglement may be attained, if necessary, by a shrinking treatment, for example, by immersing the nonwoven fabric body in a warm water kept at from 70 to 150° C. The shape of the nonwoven fabric body may be fixed by a heat press for further compacting the fibers The average apparent density of the nonwoven fabric body is preferably from 0.1 to 0.6 g/cm$^3$ when the island component polymer is nylon 6 and the sea component polymer is polyethylene. In the present invention, the average apparent density was determined, for example, by a cross-sectional observation under an electron microscope without using a load for compression. The mass per unit area of the nonwoven fabric body is 100 to 2000 g/m$^2$.

Step (c)

The nonwoven fabric body made of the sea-island fibers which are highly compacted in a desired level is impregnated with a solution of elastic polymer. Then, the elastic polymer is coagulated by a wet method.

Step (d)

The sea component polymer is removed from the sea-island fibers constituting the nonwoven fabric body by extraction or decomposition, to convert the sea-island fibers into microfine fiber bundles.

The substrate for artificial leathers thus obtained is further subjected to the steps (e) and (f) in this order or the steps (f) and (e) in this order, and then an optional step (g), thereby obtaining suede-finished or nubuck raised artificial leathers exhibiting the effects of the present invention.

Step (e)

A step for raising the microfine fibers on at least one surface of the substrate.

Step (f)

A step for dyeing the substrate.

Step (g)

A step for ordering raised microfine fibers by brushing.

Alternatively, by subjecting the substrate for artificial leathers to the step (h) and then an optional step (i), grain-finished artificial leathers exhibiting the effects of the present invention are obtained.

Step (h)

A step for forming a cover layer comprising an elastic polymer on at least one surface of the substrate.

Step (i)

A step for relaxing the substrate in a surfactant-containing water kept at 60 to 140° C.

The means for achieving the present invention will be described in more detail.

The sea-island fibers for constituting the nonwoven fabric body are multi-component composite fibers made of at least two kinds of polymers. In the cross section of such composite fibers, a kind of island component polymer is distributed in a different kind of sea component polymer which constitutes mainly the outer peripheral portion of fibers. Generally, the island component polymer is distributed in a circular or sub-circular shape because of its surface tension, and also, in a polygonal shape in some cases according to the ratio of the amounts of sea component polymer and island component polymer. At a suitable stage after making the sea-island fibers into the nonwoven fabric body and before or after impregnating an elastic polymer, the sea component polymer is removed by extraction or decomposition, thereby converting the sea-island fibers into bundles of fibers which are made of the island component polymer and thinner than the sea-island fibers. Such sea-island fibers are produced by a known chip blend method (mix spinning) or a method of spinning multi-component composite fibers such as a composite spinning method. As compared with split/division-type composite fibers having a petaline or layered cross section in which the peripheral portion of fibers is alternately formed from different components, the sea-island fibers quite little cause fiber damages such as cracking, folding and breaking during the fiber entangling treatment such as a needle punching treatment, because the outer periphery of the sea-island fibers is mainly formed from the sea component polymer. Therefore, composite fibers of a smaller fineness can be used for constituting the nonwoven fabric body. In addition, the degree of densification by entanglement can be increased. Therefore, the nonwoven fabric body is produced from the sea-island fibers in the present invention. As compared with split/division-type composite fibers, the sea-island fibers provide microfine fibers having a cross section closer to a circular shape. Therefore, the fiber bundles are made less anisotropic and the microfine fiber bundles in which the fineness, i.e., the cross-sectional area of microfine fibers is highly uniform are obtained. The substrate for artificial leathers of the present invention is characterized in the nonwoven fabric body made of a large number of fiber bundles which are compacted more closely than ever achieved. Therefore, in the present invention, a unique soft hand with fullness combined with a dense feeling is obtained by using the sea-island fibers.

The polymer for the island component of the sea-island fibers is preferably a known fiber-forming polymer. Examples thereof include polyester resins such as polyethylene terephthalate (PET), polytrimethylene terephthalate (PTT), polybutylene terephthalate (PBT), and polyester elastomers and their modified products; polyamide resins such as nylon 6, nylon 66, nylon 610, nylon 12, aromatic polyamide, semi-aromatic polyamide, and polyamide elastomers and their modified products; polyolefin resins such as polypropylene; and polyurethane resins such as polyester-based polyurethane, although not particularly limited thereto. Of these polymers, the polyester resins such as PET, PTT, PBT, and modified polyesters thereof are preferred particularly in respect of being easily shrunk upon heating and providing processed artificial leather products having a hand with dense feeling and good practical performances such as abrasion resistance, fastness to light, and shape retention. The polyamide resins such as nylon 6 and nylon 66 are hygroscopic as compared with the polyester resins and produce flexible, soft microfine fibers. Therefore, the polyamide resins are preferred particularly in respect of providing processed artificial leather products having a soft hand with fullness, a raised appearance with smooth touch, and good practical performances such as antistatic properties. The island component polymer is preferably a polymer having a melting point of 160° C. or higher, and more preferably a fiber-forming, crystallizable resin having a melting point of 180 to 330° C. If the melting point of the island component polymer is less than 160° C., the shape retention of the obtained microfine fibers fails to reach the level aimed in the present invention. Particularly, such polymer is unfavorable in view of the practical performances of processed artificial leather products. In the present invention, the melting point is the peak top temperature of the endothermic peak of the polymer which is observed when heating a polymer from room temperature to a temperature of from 300 to 350° C. according to the kind of polymer at a rate of 10° C./min in a nitrogen atmosphere, immediately cooling to room temperature, and then, heating again to a temperature of from 300 to 350° C. at a rate of 10° C./min using a differential scanning calorimeter (DSC). The microfine fibers may be added with colorant, ultraviolet absorber, heat stabilizer, deodorant, fungicidal agent, antimicrobial agent and various stabilizer at the spinning stage.

Since the sea-island fibers should be converted into microfine fiber bundles, the polymer for the sea component of sea-island fibers are required to have a solubility to solvent or decomposability by decomposer different from those of the island component polymer to be combinedly used. In view of てspinning stability, the sea component polymer is preferably less compatible with the island component polymer, and its melt viscosity or surface tension is preferably smaller than those of the island component polymer under the spinning conditions. The sea component polymer is not particularly limited as long as the above preferred requirements are satisfied. Preferred examples include polyethylene, polypropylene, polystyrene, ethylene-propylene copolymer, ethylene-vinyl acetate copolymer, styrene-ethylene copolymer, styrene-acryl copolymer, and polyvinyl alcohol resin.

The content of sea component polymer in the sea-island fibers is preferably from 5 to 70%, more preferably from 8 to 60%, and particularly preferably from 12 to 50% when expressed by the average area ratio determined on fiber cross sections. If the content is less than 5%, the industrial productivity is poor because the spinning stability of sea-island fibers is lowered. In addition, since the amount of the sea component to be removed is small, the number of intervening spaces to be formed between the microfine fiber bundles and the elastic polymer in the resultant substrate for artificial leathers are small. As a result, the raised artificial leathers and grain-finished artificial leathers unfavorably fail to acquire a soft hand with fullness combined with a dense feeling which is characteristic of natural leathers. If the content exceeds 70%, the shape and distribution of the island component on the cross section of the sea-island fibers are uneven, to deteriorate the quality. In addition, a content exceeding 70% is unfavorable because the energy and cost for recovering the removed sea component as well as the load to earth environment increase. Further, the increased amount of the sea component to be removed significantly increases the content of elastic polymer which is required for obtaining a desired level of the shape retention of the substrate for artificial leathers. With such a high content, the hand of artificial leathers aimed in the present invention is difficult to obtain.

The sea-island fibers are spun by using a composite-spinning spinneret. The spinneret has a number of arrays of nozzles disposed in parallel or a number of circles of nozzles disposed concentrically. In each array or circle, the nozzles are arranged at equal spaces. Each nozzle has 6 to 150 flow paths for the island component polymer in average and the flow paths for the sea component polymer which surround the flow paths for the island component polymer. The molten sea-island composite fibers comprising the sea component polymer and island component polymer are continuously extruded from each nozzle. The extruded molten composite fibers are uniformly made finer by pulling to an intended fineness by air jet using a sucking apparatus such as air jet nozzle, while substantially solidifying the molten composite fibers by a cooling air at any place between the nozzle and the sucking apparatus. The air jet speed is selected so that the average spinning speed, which corresponds to the mechanical take-up speed used in a general spinning method, is 1000 to 6000 m/min. The composite fibers are then collected and piled on a collecting surface such as a conveyer belt-like moving net by sucking from the surface opposite to the collecting surface, while opening the composite fibers by an impact plate or air flow according to the texture of fiber web being obtained, thereby forming a long fiber web.

When the composite-spinning spinneret is of a concentric arrangement, one nozzle-type sucking apparatus is generally used per one spinneret. Therefore, a number of sea-island fibers are gathered to the center of the concentric circles. Since the spinnerets are generally disposed in line to obtain a desired spinning amount, fibers are substantially not present between the bundles of sea-island fibers which are extruded from adjacent spinnerets. Therefore, it is important to open the fibers to make the texture of fiber web uniform. When the composite-spinning spinneret is of a parallel arrangement, a sucking apparatus having a linear slit which is disposed opposite to the spinneret is used. Therefore, since the sea-island fibers from arrays of nozzles arranged in parallel are gathered by suction, a fiber web having a more uniform texture is obtained, as compared with using a composite-spinning spinneret of a concentric arrangement. Therefore, the parallel arrangement is preferred to the concentric arrangement.

The obtained long fiber web is preferably press-bonded successively by pressing or embossing under partial heating or cooling according to the shape stability desired in the later steps. When the melt viscosity of the sea component polymer is smaller than that of the island component polymer, by heating or cooling at 60 to 120° C. without heating to a temperature as high as the melting temperature, the long fiber web can retain its texture sufficiently in the later steps without serious damage in the cross-sectional shape of the sea-island fibers constituting the long fiber web. The shape stability of the long fiber web can be enhanced to a level sufficient for winding-up.

The known method generally employed in the production of artificial leathers which includes a step of producing a fiber web of staple fibers using a carding machine requires, in addition to a carding machine, a series of large apparatuses for providing an oil agent and crimping to make the fibers to easily pass a carding machine, for cutting the fibers-into a desired length, and for transporting and opening raw fibers after cutting, and therefore, is unfavorable in view of production speed, stable production and costs. Another method using staple fibers is a paper-making method. The production of fiber web by this method also needs an apparatus for cutting and other apparatuses specific to this method, and involves the same problems as above. As compared with the methods using staple fibers, the production method of the present invention uses an extremely compact and simplified apparatus because the process from the spinning through the production of fiber web is continuously conducted in a single step, and therefore, is excellent in production speed and costs. In addition, the production method of the present invention is excellent in stable production, because free from the problems involved in the known methods, which are attributable to the combination of steps and apparatuses. As compared with the nonwoven fabric body of staple fibers in which the fibers are bound only by entanglement and impregnation of elastic polymer, the nonwoven fabric body of long fibers and the substrate for artificial leathers or artificial leathers made therefrom are excellent in the mechanical strength such as shape stability and properties such as surface abrasion resistance and bonding/peeling strength of grain layer.

By the production method of the present invention, a nonwoven fabric body can be stably produced from extremely fine fibers, although difficult in the known methods using a carding machine. By using such a nonwoven fabric body, as described below, artificial leathers having an extremely high quality not obtained ever can be obtained. In the known production of a nonwoven fabric body from staple fibers, the fibers should have a fiber diameter suitable for opening apparatus and carding machine. Generally, an average cross-sectional area of 200 $\mu m^2$ or more is required, and an average fineness of about 2 dtex or more are required for nylon 6-polyethylene composite fibers. In view of the stable industrial production, an average cross-sectional area of 300 to 600 $\mu m^2$ and an average fineness of about 3 to 6 dtex for nylon 6-polyethylene composite fibers are generally employed. In the production method of the present invention, the cross-sectional area of fibers is substantially not limited by the apparatus, and extremely fine fibers can be used as long as the spinning stability, the texture of fiber web, the bulkiness of nonwoven fabric body, the production speed in the overall steps of producing nonwoven fabric body are acceptable. In view of the spinning stability of sea-island fibers, the texture of fiber web and the quality of the substrate for artificial leathers and artificial leathers which are aimed in the present invention, the average cross-sectional area is preferably 30 $\mu m^2$ or more, and an average fineness of about 0.3 dtex or more is preferred for nylon 6-polyethylene composite fibers. The average cross-sectional area is more preferably 50 $\mu m^2$ or more, and still more preferably 80 $\mu m^2$ or more in view of the shape stability and easy handling in the later steps. Nylon 6-polyethylene composite fibers are stably and easily produced in industrial scale if the average fineness is about 0.8 dtex or more. By employing the average cross-sectional area within the above range, a fiber distribution in which the cross section of fibers nearly perpendicular to a cross section parallel to the thickness direction of fiber web exists on the cross section in a density of 80 to 700/$mm^2$, preferably 100 to 600/$mm^2$, and more preferably 150 to 500/$mm^2$ in average is obtained. With such a fiber distribution, the densified nonwoven fabric body of the present invention is finally obtained through the entanglement, etc. in the later steps.

In the present invention, it is necessary to enhance the denseness of nonwoven fabric body, particularly the denseness of nonwoven fabric body forming the surface portion of the substrate for artificial leathers. Therefore, the average cross-sectional area of microfine fiber bundles formed from the sea-island fibers is preferably 150 $\mu m^2$ or less, and the average fineness of microfine fiber bundles is, when the microfine fibers is made of nylon 6, preferably about 1.7 dtex or less. When raised artificial leathers with extremely high quality are required, the average cross-sectional area is preferably 120 $\mu m^2$ or less. When nubuck artificial leathers having short raised microfine fibers and a dense surface feeling are required, the average cross-sectional area is preferably 110 $\mu m^2$ or less and more preferably 100 $\mu m^2$ or less, and the average fineness is, when the microfine fibers is made of nylon 6, more preferably about 1.2 dtex or less. As compared with the upper limit of the average cross-sectional area of microfine fiber bundles, the lower limit thereof is not so important for the properties of substrate for artificial leathers. However, the strength and surface abrasion resistance of the artificial leathers may be significantly reduced in some cases, if the average cross-sectional area is excessively small. Therefore, to ensure practical properties in the use intended in the present invention, the average cross-sectional area of the microfine fiber bundles is 15 $\mu m^2$ or more, preferably 30 $\mu m^2$ or more, and still more preferably 40 μM2 or more.

If the average cross-sectional area of the microfine fiber bundles is 150 $\mu m^2$ or less, the substrate for artificial leathers obtained by impregnating an elastic polymer into the nonwoven fabric body has an extremely densified structure not achieved ever, in which the cross section of microfine fiber bundles oriented nearly perpendicular to a cross section parallel to the thickness direction of the substrate for artificial leathers exists on the cross section in a density of 1000 to 3000/$mm^2$ in average. In the substrate for artificial leathers made of a known nonwoven fabric body, the average cross-sectional area of microfine fiber bundles is generally as extremely large as about 300 to 600 $\mu m^2$ and the average existence density of the cross sections of microfine fiber bundles is only about 200 to 600/$mm^2$, and about 750/$mm^2$ at most. If producing a nonwoven fabric body having an average existence density exceeding 750/$mm^2$ by a known method, the fiber bundles are damaged, the shape of fiber bundles is cross-sectionally, largely deformed, and the fiber bundles are excessively compacted. Therefore, the fiber bundles are substantially prevented from moving and the obtained nonwoven fabric body has a very hard hand like a wood plate, thereby failing to obtain the substrate for artificial leathers aimed in the present invention. If a nonwoven fabric body having an average existence density of about 200 to 600/$mm^2$ at most is impregnated with an elastic polymer, a thick, continuous film of elastic polymer is formed between adjacent microfine fiber bundles because the existence density of the microfine fiber bundles is small, although depending upon the amount of elastic polymer being impregnated. With such a thick film of elastic polymer, the substrate for artificial leathers produced by a known method has a hard hand attributable to the composite structure of the nonwoven fabric body and the elastic polymer. In addition, the density thereof is significantly uneven because the region filled with fibers or elastic polymer and the region having practically no fibers and elastic polymer, i.e., empty voids are scattered here and there in the substrate for artificial leathers. Further, since the cross-sectional area of microfine fiber bundles is large, the microfine fibers in the fiber bundles are not sufficiently bound by the elastic polymer. Therefore, a larger amount of elastic polymer tends to be needed for sufficiently binding the microfine fibers.

In contrast, in the present invention, the nonwoven fabric body is produced from the fiber web in which the cross-sectional area of microfine fiber bundles is very small, the existence density of microfine fiber bundles is extremely large to create a highly dense structure, and the mechanical properties of texture are controlled. Therefore, the thickness of the elastic polymer layer for binding the microfine fiber bundles can be reduced, and the cell surrounded by the elastic polymer can be made smaller and uniformly distributed, thereby avoiding the uneven density of the substrate for artificial leathers due to large empty voids. In the known method, to obtain a nonwoven fabric body having a more densified structure, it is necessary to combine a high entanglement, a high compression and a high shrinking. This necessarily results in a high apparent density, i.e., a high mass per unit volume. In the present invention, a nonwoven fabric body having a highly densified structure not achieved ever can be obtained without increasing the apparent density. Therefore, in the present invention, a surface layer with highly compacted fibers is obtained without deteriorating the hand of the substrate for artificial leathers.

As a method of making the surface layer of substrate for artificial leathers more densified when the average cross-sectional area of microfine fiber bundles exceeds 150 $\mu m^2$, there has been proposed and employed a method of making the cross-sectional shape of microfine fiber bundles, i.e., the surface layer of nonwoven fabric body more transformable by reducing the average cross-sectional area of microfine fibers in the microfine fiber bundles to 0.8 $\mu m^2$ or less or reducing the average fineness to about 0.009 dtex or less when the microfine fibers are made of nylon 6. However, the proposed method is not preferred, because the shape stability of the nonwoven fabric body is poor due to excessively fine microfine fibers and the nonwoven fabric body is easily deformed in the length direction and width direction and easily crushed in the thickness direction. In addition, the color development in the production of raised artificial leathers is insufficient.

Each microfine fiber bundle is composed of 6 or more microfine long fibers in average in view of easy transformation and bending of fiber bundles, and composed of 150 or less microfine long fibers in view of the correlation between the upper limit and the lower limit of the average cross-sectional area of microfine fiber bundles and the spinning stability of sea-island fibers. If the amount of the sea component of sea-island fibers is needed to be reduced, each microfine fiber bundle is composed of preferably 90 or less, more preferably 50 or less and most preferably 10 to 40 microfine long fibers. If the number of microfine fibers is 5 or less in average, the fiber bundles is not easily transformed or bent. In addition, since the microfine fibers are positioned around the outermost periphery of the microfine fiber bundles, the number of microfine long fibers which comes into contact with or are bound by adhesion to the elastic polymer impregnated into the substrate for artificial leathers is increased. Therefore, the microfine fiber bundles are excessively bound, thereby failing to obtain the substrate for artificial leathers having a good hand aimed in the present invention. If the number of microfine fibers exceeds 150 in average, the degree of binding by the elastic polymer is excessively low. In view of only the hand, a sufficiently good substrate for artificial leathers may be obtained. However, the ever unknown substrate for artificial leathers aimed in the present invention which is excellent in the surface abrasion resistance such as pilling resistance cannot be obtained.

In view of the shape stability of nonwoven fabric body, the surface properties such as pilling resistance of substrate for artificial leathers or raised artificial leathers, and the color development of microfine long fibers, it is needed that 80% or more of microfine fibers has a cross-sectional area of 0.9 to 25 $\mu m^2$ and the microfine fiber bundles do not contain a microfine long fiber having a cross-sectional area exceeding 27 $\mu m^2$. If the cross-sectional area of 80% or more of microfine long fibers is less than 0.9 $\mu m^2$, the shape stability of nonwoven fabric body and the color development of raised artificial leathers aimed in the present invention are not achieved. In addition, the density of substrate for artificial leathers is uneven because of insufficient shape stability of nonwoven fabric body and the balance between the grain surface and hand of grain-finished artificial leathers is difficult to be stably controlled. If 80% or more of microfine fibers has a cross-sectional area exceeding 25 $\mu m^2$, and the microfine fiber bundles contain a microfine long fiber having a cross-sectional area exceeding 27 $\mu m^2$, the brilliantness and color development of raised artificial leathers tend to be rather improved. However, the fibers are difficult to be cut by surface friction because the tensile strength of microfine long fibers is excessively high. Therefore, the fiber bundles are pulled out of the nonwoven fabric body to significantly reduce the surface abrasion resistance, particularly the pilling resistance. To improve the surface abrasion resistance such as pilling resistance, the content of elastic polymer particularly in the surface layer is generally increased. However, since the hand of raised artificial leathers and the touch of raised surface necessarily become hard, a good raised artificial leather cannot be obtained.

If the mass per unit area or thickness of long fiber web is insufficient, the mass per unit area or thickness is regulated to a desired level by lapping or by superposing two or more long fiber webs. The lapping is made by supplying a long fiber web in the direction perpendicular to the flow direction of process and folding it nearly in its width direction, or by supplying a long fiber web in the direction parallel to the flow direction of process and folding it in its length direction. When the shape stability of nonwoven fabric body made of sea-island fibers or the denseness of fibers is insufficient or when the orientation of sea-island fibers in the nonwoven fabric body is controlled, the mechanical entangling treatment is performed by a known method such as needle punching. By the entangling treatment, the fibers in the long fiber web and the fibers in the boundary between the adjacent layers of lapped or superposed long fiber webs are three-dimensionally entangled. The entangling treatment by needle punching is performed by suitably selecting the treatment conditions such as kind of needle (shape and gauge of needle, shape and depth of barb, number and position of barb, etc.), punching density (the punching number per unit area expressed by the product of the density of needle on a needle board and the number of stroking the needle board per unit area of long fiber web), and needle-punching depth (the degree of penetration of needle into the long fiber web).

Although the kind of needle may be the same as those used in the known production of artificial leathers using staple fibers, the needles of the type mentioned below are preferably used because the gauge of needle, the depth of barb and the number of needles are particularly important for obtaining the effects of the present invention.

The gauge of needle is a factor affecting the denseness or surface quality to be obtained after the treatment. At least the blade portion (the tip portion of needle where barb is formed) is needed to be smaller (thinner) than the size #30 (the height if the cross section is a regular triangle or the diameter if the cross section is circular is about 0.73 to 0.75 mm), preferably from #32 (about 0.68 to 0.70 mm) to #46 (about 0.33 to 0.35 mm), and more preferably from #36 (about 0.58 to 0.60 mm height) to #43 (about 0.38 to 0.40 mm). A needle having a blade portion with a size larger (thicker) than #30 is highly flexible in the shape and depth of barb and preferred in view of the strength and durability on one hand, but it leaves needle-punching marks with a large diameter on the surface of nonwoven fabric body, thereby making it difficult to obtain the dense fiber assemblies and surface quality aimed in the present invention on the other hand. In addition, since the frictional resistance between the fibers in the long fiber web and the needles becomes excessively large, an excess amount of oil agent for needle-punching treatment is unfavorably needed. A needle having a blade portion with a size smaller than #46 is not suitable for industrial production in view of the strength and durability and makes it difficult to use a barb depth preferred in the present invention. In view of easily catching the fibers and reducing the frictional resistance, the cross-sectional shape of the blade portion is preferably a regular triangle.

The barb depth referred to herein is the height from the deepest portion of barb to the tip of barb. In barbs with a general shape, the barb depth is the total of the height (kickup) of the tip of barb outwardly projecting from the side of needle and the depth (throat depth) of the depressed portion on the side of needle. The barb depth is equal to or more than the diameter of sea-island fibers and preferably 120 μm or less. If smaller than the diameter of sea-island fibers, the sea-island fibers are hardly caught by the barb. If exceeding 120 μm, although the sea-island fibers are extremely easily caught by the barb, needle-punching marks with a large diameter are likely formed on the surface of nonwoven fabric body, thereby making it difficult to obtain the dense fiber assemblies and surface quality aimed in the present invention. The barb depth is preferably from 1.7 to 10.2 times, more preferably from 2.0 to 7.0 times the diameter of sea-island fibers. If less than 1.7 times, the effect of entanglement corresponding to an increased punching number described below is not obtained in some cases, provably because the sea-island fibers are hardly caught by barb. If exceeding 10.2 times, the damage such as breaking and cracking of sea-island fibers tends to increase rather than the sea-island fibers come to be easily caught by barb.

The number of barbs is suitably selected from 1 to 9 so as to obtain the effect of entanglement. To obtain a nonwoven fabric body with a dense structure, the needle mainly used in the entangling treatment by needle-punching, i.e., the needle used for the punching of 50% or more of the punching number mentioned below preferably has from 1 to 6 barbs. The numbers of barbs of needles used in the entangling treatment by needle punching are not necessarily the same, and needles having different numbers of barbs, for example, needles having 1 barb and needles having 9 barbs, needles having 1 barb and needles having 6 barbs, needles having 3 barbs and needles having 9 barbs, etc. may be used combinedly or used in a given order. In a needle having two or more barbs, the barbs may be positioned at different distances from the tip thereof or some of the barbs may be positioned at the same distance from the tip. An example of the latter needle has a blade portion having a cross-sectional shape of regular triangle and barbs on the respective three vertexes at the same distance from the tip. The former needles are mainly used in the present invention for the entangling treatment. A needle having barbs at the same distance from the tip looks to have a thicker blade portion and the barb depth is large. Although a large effect of entanglement is obtained by such a needle, it has significant disadvantages caused by the thick blade portion and the excessively large barb depth. In addition, when the needle-punching treatment is carried out using the latter needles, many fibers (from ten or more fibers to tens of fibers) are oriented in group along the thickness direction of nonwoven fabric body. Therefore, the dense structure aimed in the present invention tends to be difficult to obtain if the needle-punching treatment is carried out longer. Namely, the number of fibers oriented nearly parallel to a cross section which is taken along the thickness direction of nonwoven fabric body increases, but the existence density of fibers nearly perpendicular to the cross section tends to significantly decreases. Since a large effect of entanglement is obtained even when the punching number is small, the latter needles may be preferably used partly in the entangling treatment. For example, the entangling treatment may be carried out using the latter needles at any stage between the initial stage and the middle stage of the entangling treatment in a degree not adversely affecting the aimed dense structure, and then, carried out using the former needles to obtain the aimed dense structure.

The total number of needle punching is preferably from 300 to 4000 punch/cm$^2$ and more preferably from 500 to 3500 punch/cm$^2$. When the needles having barbs at the same distance from the tip are used, the total number of needle punching is about 300 punch/cm$^2$ or less, and preferably from 10 to 250 punch/cm$^2$. The needle-punching treatment exceeding 300 punch/cm$^2$ unfavorably orients a number of fibers to the thickness direction. Therefore, the existence density of nonwoven fabric body may be difficult to increase even when an additional needle punching, a shrinking treatment or a press treatment is subsequently performed.

The average existence density required in the nonwoven fabric body made of the sea-island fibers (the number of cross sections of fibers nearly perpendicular to a cross section parallel to the thickness direction per unit area of the cross section) is from 600 to 4000/mm$^2$, preferably from 700 to 3800/mm$^2$, and more preferably from 800 to 3500/mm$^2$. To obtain a dense structure having the average existence density within the above range, a heat-shrinking treatment by hot air, hot water or steam may be preferably performed in addition to the entangling treatment by needle punching. By combining one or more of these treatments with the entangling treatment, the dense structure aimed in the present invention is finally obtained. In addition to the entangling treatment and shrinking treatment, a press treatment may be conducted simultaneously with, before or after the entangling treatment and shrinking treatment.

After the entangling treatment by needle punching, after the entangling treatment by needle punching and the heat-shrinking treatment, or after the heat-shrinking treatment, the denseness (average existence density) of the nonwoven fabric body made of the sea-island fibers is preferably 50% or more and more preferably 55 to 130% of the denseness finally needed. For example, if the final denseness is required to be 2000/mm$^2$, the average existence density of the nonwoven fabric is preferably 1000/mm$^2$ or more.

To obtain a highly dense nonwoven fabric body by a densifying treatment mainly comprising needle punching using preferred needles as describe above, the total punching number is preferably from 800 to 4000 punch/cm$^2$ and more preferably from 1000 to 3500 punch/cm$^2$. If less than 800 punch/cm$^2$, the densification is insufficient and the fibers in different long fiber webs may be not entangled sufficiently to unite the nonwoven fabric body loosely. If exceeding 4000 punch/cm$^2$, although depending upon the shape of needles, the damage of fibers such as breaking and cracking by needles becomes remarkable. When the fibers are damaged severely, the shape stability of nonwoven fabric body is drastically reduced and the denseness may be rather lowered in some cases.

In view of the mechanical properties such as shape stability and tear strength of the resulting nonwoven fabric body and substrate for artificial leathers and the orientation of the fibers in the thickness direction, it is preferred to allow the barbs of needles to act as much as possible on the long fiber web throughout its thickness. Therefore, the needle punching depth is preferably set so that the barb nearest the tip of needle penetrate through the long fiber web. To achieve the dense structure not obtained ever, the punching of 50% or more, preferably 70% or more of the punching number are performed so that the barbs penetrate through the long fiber web. If the punching depth is excessively large, the damage of fibers due to barbs may become remarkable and punching marks may be left on the surface of nonwoven fabric body. Therefore, the needle-punching conditions should be selected by taking these problems into consideration.

When the entangling treatment is carried out by needle punching, to prevent the fibers from being damaged by needles and avoid the electrification and generation of heat due to strong friction between needles and fibers, an oil agent is preferably added to the long fiber web at any stage after the production of long fiber web and before the entangling treatment. The oil agent is added by a known coating method such as spray coating, reverse coating, kiss roll coating and lip coating, with the spray coating being most preferred because it is in non-contact with the long fiber web and an oil agent having a low viscosity which penetrates into the inside of long fiber web quickly can be used. The words "after the production of long fiber web" referred above means the stage after the melt-spun sea-island fibers are collected and piles on a collecting surface such as moving net. The oil agent to be added before the entangling treatment may comprise a single kind of component. Preferably, two or more kinds of oil agents having different effects are used in mixture or separately. The oil agent having a high lubricating effect which reduces the friction between needles and fibers, i.e., the friction between metal and polymer is used in the present invention. Polysiloxane oil agents are preferred and an oil agent mainly comprising dimethylsiloxane is more preferred. Another oil agent may be used in combination with the oil agent having a high lubricating effect. As such another oil agent, preferred is an oil agent having a high friction effect which prevents the entangling effect by catching the fibers on barbs from being partly significantly reduced due to excessively high lubricating effect, or prevents the entangled state from being difficult to be kept because of a significant lowering of the friction coefficient between fibers. Preferred example thereof include an oil agent based on mineral oil. When the electrification due to friction is remarkable, it is preferred to combinedly use a surfactant, for example, a polyoxyalkylene surfactant as an antistatic agent.

The long fiber web, its superposed body or the long fiber web after the entangling treatment is subjected to a heat-shrinking treatment in hot water, high-temperature atmosphere or high-temperature, high-humidity atmosphere to obtain a desired denseness, if needed. Tb obtain a nonwoven fabric body having an average existence density of about 800 to 1000/mm$^2$, for example, the long fiber web is first densified to about 500 to 700/mm$^2$ by the entangling treatment and then further densified to a desired level by the shrinking treatment. It is preferred for the heat-shrinking treatment to form the long fiber web from shrinkable sea-island fibers, form the long fiber web from a combination of sea-island fibers and shrinkable fibers, or superpose a shrinkable web which is separately produced. The shrinkable sea-island fibers are produced by spinning using a heat-shrinkable polymer for the sea component polymer, island component polymer or both. Examples of the heat-shrinkable island component polymer include polyester resins, polyamide resins such as copolymers of different nylons, and polyurethane resins. The shrinking treatment conditions are not particularly limited as long as the treatment is conducted at temperatures where a sufficient shrinking occurs, and suitably determined according to the shrinking treatment method to be employed, the amount to be treated, etc. For example, the shrinking treatment is conducted in hot water at 70 to 150° C.

In addition to the entangling treatment by needle punching and the heat-shrinking treatment, it is preferred, if needed, to subject the nonwoven fabric body made of the sea-island fibers to a press treatment prior to the impregnation of elastic polymer mentioned below so as to obtain a desired denseness. For example, a denseness of an average existence density of about 800 to 1000/mm$^2$ is achieved by first densifying the nonwoven fabric body to about 600 to 800/mm$^2$ by the entangling treatment and then further densifying to a desired level by the press treatment. The press treatment is preferably conducted immediately after the heat-shrinking treatment while the nonwoven fabric body is still hot. By employing these treatments, the densification by the press treatment proceeds nearly simultaneously with the densification by the shrinking treatment and the denseness more uniform than that obtained by only the press treatment is obtained and the production efficiency can be enhanced. The combination of the heat-shrinking treatment and the press treatment is more effective for densification, when the sea component polymer in the sea-island fibers constituting the nonwoven fabric body has a softening temperature lower than that of the island component polymer by 20° C. or more, preferably 30° C. or more. In case of meeting this requirement, only the sea component polymer in the sea-island fibers is softened or nearly softened by heating from a temperature close to the softening temperature of sea component polymer to a temperature lower than the softening temperature of island component polymer. By pressing at such a state, the nonwoven fabric body is compressed more densely, and by cooling it to room temperature, the nonwoven fabric body having a desired denseness is obtained. In addition to the densifying effect, the press treatment has an effect of making the surface of nonwoven fabric body smoother. By smoothing the surface, the extremely dense assemblies of microfine fiber bundles which is most important feature of the substrate for artificial leathers of the present invention is effectively obtained. With such a smooth surface of substrate for artificial leathers, the grinding amount in a treatment for forming raised nap by buffing, etc. in the production of raised artificial leathers can be reduced. Further, in the production of grain-finished artificial leathers, a smooth grain layer having a thickness as extremely small as 50 μm or less can be stably formed without heat-pressing or buffing the surface of substrate.

Then, a given amount of elastic polymer is impregnated into the dense nonwoven fabric body having an average existence density of 600 to 4000/mm$^2$ preferably prior to the removal of the sea component polymer. A solution or dispersion of the elastic polymer is impregnated and then the elastic polymer is coagulated by a known dry method or wet method. The impregnation is conducted by various known coating methods such as a dip-nip method in which a treatment comprising a step of dipping the nonwoven fabric body in a bath of a solution of elastic polymer and a step of nipping by a press roll, etc. to regulate the impregnated amount to a desired level is performed once or more, a bar coating method, a knife coating method, a roll coating method, a comma coating method, and a spray coating method. These methods may be used alone or in combination of two or more.

The elastic polymer to be impregnated into the nonwoven fabric body may be any of those conventionally used in the production of substrate for artificial leathers. Examples thereof include various types of polyurethane which are produced by a single-stage or multi-stage reaction of a raw material mainly composed of at least one polymer polyol having an average molecular weight of 500 to 3000 and at least one polyisocyanate in combination with at least one low molecular compound having two or more active hydrogen atoms in a given molar ratio. Examples of the polymer polyol include polyester diol, polyether diol, polyether ester diol, and polycarbonate diol. Examples of the polyisocyanate include aromatic, alicyclic, and aliphatic diisocyanates such as 4,4'-diphenylmethane diisocyanate, isophorone diisocyanate, and hexamethylene diisocyanate. Examples of the low molecular compound include ethylene glycol and ethylene diamine. The substrate for artificial leathers impregnated with an elastic polymer mainly composed of polyurethane is well balanced between hand and mechanical properties in addition to durability. The elastic polymer may be a mixture of different types of polyurethane. Different types of polyurethane may be impregnated in several portions. An elastic polymer composition of polyurethane and another elastic polymer such as synthetic rubber, polyester elastomer and acrylic resin which is added if needed is usable.

After impregnating the elastic polymer liquid such as solution or dispersion of elastic polymer into the nonwoven fabric body, the elastic polymer is coagulated by a known dry method or wet method, thereby fixing the elastic polymer in the nonwoven fabric body. The dry method includes a general method of fixing the elastic polymer in the nonwoven fabric body by drying to remove the solvent or dispersion medium. The wet method includes a general method in which prior to removing the solvent or dispersion medium the elastic polymer is temporarily or completely fixed in the nonwoven fabric body by treating the nonwoven fabric body impregnated with an elastic polymer liquid with a non-solvent or coagulating agent for the elastic polymer or by heat-treating the nonwoven fabric body impregnated with an elastic polymer liquid added with a heat-sensitive gelling agent, etc.

The elastic polymer liquid may be added with various additives such as colorant, coagulation regulator and antioxidant which are added to the elastic polymer liquid to be impregnated into the known substrate for artificial leathers. The amount of the elastic polymer or elastic polymer composition to be impregnated into the nonwoven fabric body is suitably changed according to the mechanical properties, durability and hand required for the intended use. The elastic polymer is used in an amount which gives a mass per unit area of elastic polymer preferably from 10 to 150% by mass and more preferably from 30 to 120% by mass of the mass per unit area of nonwoven fabric body made of the microfine fiber bundles when it is taken as 100. If less than 10% by mass, the elastic polymer enters between adjacent microfine fiber bundles in the substrate for artificial leathers and comes into contact with or adheres to the microfine fiber bundles, thereby reducing the effect of preventing the microfine fiber bundles from moving in the length direction. In particular, it is difficult to obtain the effect of the present invention on the surface abrasion resistance such as pilling resistance of the raised artificial leathers. If exceeding 150% by mass, the pilling resistance is not adversely affected and the surface abrasion resistance tends to be rather improved. However, the hand of substrate for artificial leathers and the hand of grain-finished artificial leathers and raised artificial leathers produced from the substrate for artificial leathers are made significantly hard, thereby highlighting a rubbery feeling. In particular, the raised surface of raised artificial leathers tends to have a rough touch.

To reduce the degree of hardening of hand due to the impregnation of elastic polymer, in the known production of artificial leathers, a resin such as polyvinyl alcohol resin which is removable by dissolution is provided to the nonwoven fabric body prior to the impregnation of elastic polymer liquid and its coagulation in an amount according to the amount of elastic polymer to be added. Since the polyvinyl alcohol resin is interposed between the fibers constituting the nonwoven fabric body and the impregnated elastic polymer, the contact and adhesion between the fibers and the elastic polymer hardly occur after removing the resin. In the present invention, however, the nonwoven fabric body made of extremely dense fiber assemblies not ever achieved is used, and fine sea-island fibers or microfine fiber bundles not ever used in the known production of substrate for artificial leathers are used. Therefore, it is difficult to coat the fibers constituting the nonwoven fabric body uniformly with the added polyvinyl alcohol resin and also it is difficult to uniformly make the space for receiving the added elastic polymer between the coated fibers. In addition, the region in which the resin is locally solidified and the region in which the resin is scarcely present are scattered in places in the nonwoven fabric body. Therefore, the addition of polyvinyl alcohol resin is not preferably applicable to the present invention in order to prevent the hand from being hardened. However, the resin may be added in a small amount not adversely affecting the effect of the present invention, for example, in an amount as small as about 20% by mass or less of the mass per unit area of nonwoven fabric body in order to improve the shape stability of nonwoven fabric body by temporarily fixing the fibers or in order to aid the improvement of the process passing properties in the step of impregnating the elastic polymer.

The sea component polymer is removed from the sea-island fibers constituting the nonwoven fabric body before or after impregnating the elastic polymer preferably by treating the nonwoven fabric body with a liquid which is a non-solvent or non-decomposing agent for the island component polymer, a non-solvent or non-decomposing agent for the elastic polymer when the removal is conducted after impregnating the elastic polymer, and a solvent or decomposing agent for the sea component polymer. When the island component polymer is a polyamide resin or a polyester resin each being preferably used in the present invention, the following liquids are preferably used for the removal of the sea component polymer: organic solvents such as toluene, trichloroethylene and tetrachloroethylene when the sea component polymer is polyethylene; hot water when the sea component polymer is a hot water-soluble polyvinyl alcohol resin; alkaline decomposing agents such as aqueous solution of sodium hydroxide when the sea component polymer is a modified polyester easily decomposed by alkali. If the nonwoven fabric body being treated for removing the sea component polymer does not contain the elastic polymer or contains polyurethane which is preferably used in the present invention, any of the solvents and decomposing agents described above may be used. If the organic solvent or alkaline decomposing agent is used, it is recommended to prevent the degradation of elastic polymer during the removing treatment by varying the composition of elastic polymer to be impregnated. By such a treatment for removing the sea component polymer, the sea-island fibers are converted to the microfine fiber bundles made of the island component polymer, to obtain the substrate for artificial leathers of the present invention which preferably has a mass per unit area of 60 to 1800 g/m$^2$.

Like the production of known artificial leathers, the thickness of the substrate for artificial leathers thus produced is, if needed, regulated by slicing the substrate in two or more sheets and grinding the surface for the back of the sliced sheet. Also, one or both surfaces may be treated with a liquid containing the elastic polymer or a solvent for microfine fiber bundles. Thereafter, by raising at least the surface for the top by a buffing treatment, etc., a raised surface mainly comprising the microfine fibers is formed, thereby obtaining suede-finished or nubuck-finished raised artificial leathers. In addition, grain-finished artificial leathers are obtained by forming a cover layer made of the elastic polymer on the surface for the top.

To form the raised surface, any of known methods such as a buffing treatment using sandpaper or a card clothing and a brushing treatment may be used. Before or after the raising treatment, the surface to be raised or the raised surface may be coated with a solvent capable of dissolving or swelling the elastic polymer or the microfine fiber bundles, for example, a treating liquid containing dimethylformamide (DMF) when the elastic polymer is polyurethane or a treating liquid containing a phenol compound such as resorcine when the microfine fiber bundles are made of the polyamide resin. With this treatment, the binding of microfine fiber bundles by the adhesion of the elastic polymer to the microfine fiber bundles, the length of raised microfine fibers of raised artificial leathers and the surface abrasion resistance can be controlled finely.

The cover layer comprising an elastic polymer is formed by any of the known methods such as a method in which a liquid containing the elastic polymer is directly coated on the surface of substrate for artificial leathers and a method in which the liquid is coated on a supporting substrate such as a releasing paper to form a film and then the film is bonded to the substrate for artificial leathers. The elastic polymer for forming the cover layer may be a known elastic polymer for use in forming the cover layer of known grain-finished artificial leathers, for example, selected from the elastic polymers mentioned above to be impregnated into the nonwoven fabric body. The thickness of cover layer is not particularly limited, and may be about 300 μm or less because grain-finished artificial leathers sufficiently balanced with the substrate for artificial leathers of the present invention with respect to hand are obtained. When producing grain-finished artificial leathers having an extremely smooth, uniform surface layer which can be achieved by the dense assemblies of the microfine fiber bundles, i.e., the most important feature of the substrate for artificial leathers of the present invention, the thickness of cover layer is about 100 μm or less, preferably about 80 μm or less, and more preferably from about 3 to 50 μm. With the cover layer having such a thickness, grain-finished artificial leathers having extremely fine buckling grains resembling natural leathers are also produced.

The raised artificial leathers and grain-finished artificial leathers may be dyed in any stage after converting the sea-island fibers to the microfine fiber bundles. In the present invention, any of dyeing methods using a dye suitably selected according to the kind of fibers and a known dyeing machine generally used for dyeing known artificial leathers may be used. Examples of dye include acid dye, metal complex dye, disperse dye, sulfur dye, and sulfur vat dye. Examples of dyeing machine include padder, jigger, circular, and wince dyeing machines. In addition to dyeing, if necessary, a finishing treatment may be preferably employed, which includes a mechanical crumpling treatment in dry state, a relaxing treatment in wet state using a dyeing machine or washing machine, a softening treatment, a functionalizing treatment using softening agent, flame retardant, antimicrobial agent, deodorant, water-oil repellant, etc., a treatment for improving touch using silicone resin, treating agent containing silk protein, grip-improving resin, etc., and a treatment for enhancing appearance by coating colorant or resin other than those mentioned above such as enameling coating resin. Since the microfine fiber bundles in the substrate for artificial leathers of the present invention are highly, densely assembled, the hand is significantly improved by the relaxing treatment in wet state and the softening treatment. Therefore, these treatments are preferably employed in the production of grain-finished artificial leathers. For example, artificial leathers having a soft feeling and fullness closely resembling natural leathers are produced by the relaxing treatment in water containing a surfactant at about 60 to 140° C. without deteriorating a dense feeling attributable to the dense structure.

EXAMPLES

The present invention will be described in more detail with reference to the following examples. However, it should be noted that the scope of the present invention is not limited thereto. In the following, "part(s)" and "%" are based on mass unless otherwise noted.

(1) Cross-Sectional Area of Microfine Fiber, Average Cross-Sectional Area of Microfine Fiber Bundle, and Average Number of Bundled Fibers in Microfine Fiber Bundle The cross section taken along the thickness direction of a substrate for artificial leathers was observed under a scanning electron microscope (about 100 to 300 magnitude), and 20 microfine fiber bundles which were oriented nearly perpendicular to the cross section were randomly and evenly selected from the observing field. The cross section of each of the selected microfine fiber bundles was magnified about 1000 to 3000 times, to measure the cross-sectional area of microfine fiber and the number of bundled fibers in the microfine fiber bundle.

Using the measured cross-sectional area of microfine fiber and the number of bundled fibers, the cross-sectional area was calculated for each of the selected 20 microfine fiber bundles. The average cross-sectional area of microfine fiber bundles constituting the substrate for artificial leathers was determined by arithmetically averaging 18 cross-sectional areas while excluding the maximum value and the minimum value. If the numbers of bundled fibers varied from bundle to bundle, the average number of bundled fibers of the microfine fiber bundles constituting the substrate for artificial leathers was determined by arithmetically averaging the numbers of bundled fibers of 18 microfine fiber bundles while excluding the maximum value and the minimum value.

(2) Average Existence Density (the Number of the Cross Sections of Microfine Fiber Bundles Per Unit Area of a Cross Section Parallel to the Thickness Direction)

A cross section of a substrate for artificial leathers parallel to its thickness direction was observed under a scanning electron microscope (about 100 to 300 magnitude). The number of the cross sections which were judged to be nearly perpendicular to the length direction of microfine fiber bundles was counted on each of 3 to 10 fields (total area of observing fields: 0.5 $mm^2$ or more). The total of counted numbers was divided by the total area of observing fields to obtain the number of cross sections of microfine fiber bundles per 1 $mm^2$. The average existence density of substrate for artificial leathers was determined by arithmetically averaging the numbers of the cross sections of microfine fiber bundles per 1 $mm^2$ throughout the observing field.

(3) Evaluation of Appearance of Raised Artificial Leathers

A raised artificial leather was visually observed by 5 panelists selected form those skilled in artificial leather art and evaluated for its appearance according to the following ratings. The result is shown by the rating given by most of panelists.

A: Extremely highly dense throughout raised surface and smooth touch with no roughness.

B: Slightly less dense throughout raised surface or partially rough although relatively highly dense throughout raised surface, and relatively rough touch.

C: Rough throughout raised surface and considerably rough touch.

(4) Evaluation of Hand of Raised Artificial Leathers

A raised artificial leather was made into a golf glove by sewing when the thickness was less than 0.8 mm, a jacket by sewing when the thickness was 0.8 to 1.2 mm, and a sofa by sewing when the thickness exceeded 1.2 mm. Each product was subjected to wear trial and evaluated for the hand of the raised artificial leather by 5 panelists selected form those skilled in artificial leather art according to the following ratings. The result is shown by the rating given by most of panelists.

A: Soft hand with fullness combined with sufficient dense feeling, and good fit feeling of product.

B: Unsatisfied hand lacking in any of soft feeling, fullness and dense feeling, and insufficient fit feeling of product (same as general raised artificial leathers with respect to hand and fit feeling).

C: Extremely poor in any or all of soft feeling, fullness and dense feeling, and poor fit feeling (inferior to general raised artificial leathers with respect to hand and fit feeling).

(5) Evaluation of Surface Abrasion Resistance

The surface of a raised artificial leather was abraded according to Martindale abrasion test of JIS L1096 under a load of 12 kPa and the number of abrasion of 5000 times. When the difference in mass (abrasion loss) before and after the test was 50 mg or less, the abrasion resistance was judged good. The variation of pilling on the surface of raised artificial leather before and after the test was visually observed and evaluated by the following ratings. When the abrasion resistance was good and the pilling resistance was A or B, the surface abrasion resistance was judged good.

A: No increase in pilling (decrease in pilling by cutting of raised fibers is allowable).

B: Slight increase in pilling but no increase in hard pilling.

C: Noticeable increase in pilling and noticeable increase in hard pilling.

(6) Evaluation of Appearance of Grain-Finished Artificial Leather

A grain-finished artificial leather was observed by 5 panelists selected form those skilled in artificial leather art and evaluated for its appearance according to the following ratings. The result is shown by the rating given by most of panelists.

A: Natural leather-like highly smooth surface with fine buckling grains.

B: Partly poor in surface smoothness or slightly poor in smoothness throughout surface, and partly rough buckling grains or slightly rough throughout surface.

C: Clearly poor in surface smoothness and rough buckling grains throughout surface.

(7) Evaluation of Hand of Grain-Finished Artificial Leather

A grain-finished artificial leather was made into a golf glove by sewing when the thickness was less than 0.8 mm, a jacket by sewing when the thickness was 0.8 to 1.2 mm, and a sofa by sewing when the thickness exceeded 1.2 mm. Each product was subjected to wear trial and evaluated for the hand of the raised artificial leather by 5 panelists selected form those skilled in artificial leather art according to the following ratings. The result is shown by the rating given by most of panelists.

A: Soft hand with fullness combined with sufficient dense feeling, good uniformity of grain layer and substrate, and good fit feeling of product.

B: Unsatisfied hand lacking in any of soft feeling, fullness, dense feeling and uniformity, and insufficient fit feeling of product (same as general grain-finished artificial leathers with respect to hand and fit feeling).

C: Extremely poor in any or all of soft feeling, fullness, dense feeling and uniformity, and poor fit feeling (inferior to general grain-finished artificial leathers with respect to hand and fit feeling).

(8) Evaluation of Bonding/Peeling Strength of Grain-Finished Artificial Leather

Three lengthwise test pieces (250 nm in the length direction and 25 mm in the width direction) were cut out of a grain-finished artificial leather. Similarly, three widthwise test pieces (25 mm in the length direction and 250 mm in the width direction) were obtained. Each test piece was cleaned by wiping the surfaces with gauze impregnated with methyl ethyl ketone (MEK) and then dried at room temperature for about 2 to 3 min while keeping the test piece away from dirt. After slightly buffing one surface of a crepe rubber sheet (150 mm long, 27 mm wide and 5 mm thick), the dirt on the buffed surface was cleaned by MEK in the same manner as above. After adding a curing agent to a commercially available polyurethane adhesive for shoes (solid content: 20%) in an amount of 5%, the mixture was sufficiently stirred. Immediately after mixing, 0.1 to 0.2 g of the mixture was coated in uniform thickness on the marginal area of about 90 mm from the lengthwise end of each of the test piece and the rubber sheet. Thereafter, the test piece and the rubber sheet were dried at room temperature for 2 to 3 min and then heated at 100 to 120° C. for about 3 min in a dryer to initiate the curing reaction. Then, the test piece and the rubber sheet were put together with the surfaces coated with the adhesive being faced and uniformly press-bonded. Finally, the bonded product was heated at 60 to 80° C. for about one hour in a dryer to further promote the curing reaction, to obtain a firmly bonded measuring piece.

The unbonded portion of the test piece was folded back so that the unbonded portion of the test piece and the unbonded portion of the rubber sheet formed an angle of about 180°. Then, the measuring piece was clipped to the upper and lower chucks (chuck interval: 150 mm) of a tensile tester with the rubber sheet being positioned lower. Then a 180° peeling test was performed at a tensile speed of 100 m/min and the stress was recorded on a chart during the test. When the test piece is too hard to carry out the 180° peeling, T peeling likely occurs. To prevent T peeling, the measuring piece may be clipped to chucks with a metal reinforcing plate (about 150 mm thick, 30 mm wide and 2 mm thick) being superposed to the back surface of the rubber sheet. The average measurement of stress was employed as the bonding/peeling strength of test piece, which was determined on the stress curve excluding the maximum value at the initiation of peeling and the minimum value immediately thereafter. By arithmetically averaging the values of strength respectively measured on three lengthwise test pieces and three widthwise test pieces, the bonding/peeling strength in each of length direction and width direction was obtained.

Example 1

A linear low density polyethylene (LDPE, sea component polymer) and nylon 6 (Ny6, island component polymer) were separately melted. Then, the molten polymers were fed into a composite-spinning spinneret. The spinneret was provided with a number of nozzles arranged in parallel and capable of forming a cross section in which 25 islands of island component polymer having a uniform cross-sectional area were distributed in the sea component polymer. The molten polymers were fed into the spinneret in a pressure balance which regulated the average areal ratio of the sea component polymer and the island component polymer on the cross sections to sea/island=50/50 and the fed polymers were extruded from nozzles at a spinneret temperature of 290° C. The extruded polymers were made thinner by pulling using an air jet-nozzle type sucking apparatus by which the pressure of air jet was regulated so as to obtain an average spinning speed of 3600 m/min, thereby spinning sea-island fibers having an average cross-sectional area of 160 $\mu m^2$ (about 1.6 dtex). The sea-island fibers were continuously collected on a net while sucking from the back side. The pile amount of the sea-island fibers was controlled by changing the moving speed of net. The sea-island fibers collected on the net were lightly pressed by an emboss roll kept at 80° C., to obtain a long fiber web having an average mass per unit area of 30 $g/m^2$. On a cross section parallel to the thickness direction of the obtained long fiber web, the cross sections of sea-island fibers exsted in an average density of 350/$mm^2$. The shape of the long fiber web was stabilized enough to wind up.

The obtained long fiber web was made into a layered long fiber web with 20 layers in average by using a cross lapping apparatus. An oil agent mainly comprising a dimethyl polysiloxane-based lubricating oil agent additionally mixed with a mineral oil and an antistatic agent was sprayed on to the surface of the layered long fiber web. Thereafter, the layered long fiber web was entangled by a needle punching method using the needles A (needle gauge #40, 40 μm barb depth, one barb, regular triangle cross section) and the assist needles B (needle gauge #42, 40 μm barb depth, six barbs, regular triangle cross section). The needle punching was performed from both sides of the web in a total punching density of 1200 punch/$cm^2$ while allowing the barb of needle A and three barbs from the tip of needle B to penetrate through the web in the thickness direction, thereby entangling the sea-island fibers in the thickness direction. Then, the entangled web was heat-shrunk at ambient temperature of 150° C. and pressed with a metal roll kept at 10° C., to obtain a nonwoven fabric body having an average mass per unit area of 650 $g/m^2$. On a cross section parallel to the thickness direction of nonwoven fabric body, the cross sections of sea-island fibers existed in an average density of 1200/$mm^2$. Thus, the sea-island fibers were extremely densely assembled in the obtained nonwoven fabric body.

The obtained nonwoven fabric body was impregnated with an elastic polymer liquid comprising 13 parts of a polyurethane composition mainly composed of a polyether-based polyurethane and 87 parts of dimethylformamide (DMF) and the polyurethane composition was wet-coagulated in water. After removing DMF by washing with water, the low density polyethylene in the sea-island fibers was removed by extraction with hot toluene. Then, toluene was azeotropically removed in hot water bath and the fabric was dried to obtain an inventive substrate for artificial leathers having a thickness of about 1.3 mm, which comprised the nonwoven fabric body constituted by bundles of nylon 6 microfine long fibers and the polyurethane impregnated into the nonwoven fabric body.

The average cross-sectional area of microfine fibers was 2.6 $\mu m^2$, the number of bundled fibers was 25, and the cross-sectional area of bundled microfine fibers was uniform. The average cross-sectional area of microfine fiber bundles was 68 $\mu m^2$ and microfine fiber bundles contained no microfine fibers having a cross-sectional area exceeding 27 $\mu m^2$. The number of cross sections of microfine fiber bundles existing in unit area of a cross section parallel to the thickness direction of the substrate was 1700/$mm^2$ in average. The most part of microfine fiber bundles did not adhere to the elastic polymer.

Example 2

The substrate for artificial leathers obtained in Example 1 was sliced and divided in two in the thickness direction. The divided surface was buffed with sandpaper and the average thickness was regulated to 0.62 mm. The other surface was raised by buffing using an emery buffing machine equipped with sandpaper and the raised fibers were ordered by brushing, to form a raised surface of microfine fibers. Thereafter, a nubuck artificial leather was obtained by dyeing with Irgalan Red 2GL (Ciba Specialty Chemicals) in a concentration of 4% owf and brushing for ordering the raised fibers. The number of cross sections of microfine fiber bundles existing in unit area of a cross section parallel to the thickness direction of the substrate was 1500/mm$^2$. The raised surface had an extremely high denseness, but combined a good color development not ever achieved. In addition, the nubuck artificial leather was excellent in all of the appearance, hand, and surface abrasion resistance, to exhibit the effect aimed in the present invention. The evaluation results are shown in Table 1.

Example 3

An inventive substrate for artificial leather having a thickness of about 1.0 mm was produced in the same manner as in Example 1 except for changing the elastic polymer liquid to be impregnated into the nonwoven fabric body to a liquid comprising 18 parts of a polyurethane composition mainly composed of a mixed polyurethane composed of 65% of a polycarbonate-based polyurethane and 35% of polyether-based polyurethane and 82 parts of DMF. The obtained substrate comprised a nonwoven fabric body made of bundles of nylon 6 microfine long fibers and the polyurethane impregnated in the nonwoven fabric body.

The measured cross-sectional area of microfine fibers, number of bundled fibers, and cross-sectional area of microfine fiber bundles were similar to those in Example 1. Similarly to Example 1, the microfine fiber bundles contained no microfine fibers having a cross-sectional area exceeding 27 μm$^2$. The number of cross sections of microfine fiber bundles existing in unit area of a cross section parallel to the thickness direction of the substrate was 2200/mm$^2$ in average. The most part of microfine fiber bundles did not adhere to the elastic polymer.

Example 4

One of the surfaces of the substrate for artificial leathers obtained in Example 2 was buffed with sandpaper to regulate the average thickness to 0.97 mm. The other surface was raised by buffing using an emery buffing machine equipped with sandpaper and the raised fibers were ordered by brushing, to form a raised surface of microfine fibers. Thereafter, a nubuck artificial leather was obtained by dyeing with Irgalan Red 2GL (Ciba Specialty Chemicals) in a concentration of 4% owf and brushing for ordering the raised fibers. The number of cross sections of microfine fiber bundles existing in unit area of a cross section parallel to the thickness direction of the substrate was 1950/mm$^2$ in average. The raised surface had an extremely high denseness, but combined a good color development not ever achieved. In addition, the nubuck artificial leather was excellent in all of the appearance, hand, and surface abrasion resistance, to exhibit the effect aimed in the present invention. The evaluation results are shown in Table 1.

COMPARATIVE EXAMPLE 1

A substrate for artificial leathers was produced in the same manner as in Example 1 except for changing the areal ratio of the sea component polymer and the island component polymer of the sea-island fibers for constituting the long fiber web to sea/island=25/75, changing the average cross-sectional area of sea-island fibers to 175 μm$^2$, and performing the entangling treatment by needle punching using needles C having 9 barbs in place of the needles A and needles B. The obtained substrate was made into a nubuck artificial leather in the same manner as in Example 2. Although the color development was good, the obtained nubuck artificial leathers failed to satisfy the levels aimed in the present invention in other properties. The evaluation results are shown in Table 1.

COMPARATIVE EXAMPLE 2

In separate extruders, 65 parts of nylon 6 (island component) and 35 parts of a low density polyethylene (sea component) were melted, respectively. The molten polymers were fed into a composite-spinning spinneret and extruded from nozzles at a spinneret temperature of 290° C. The spinneret was provided with a number of nozzles arranged concentrically and capable of forming a cross section in which 50 islands of island component polymer having a uniform cross-sectional area were distributed in the sea component polymer. The extruded polymers were made thinner by pulling while bringing them together, to spin the sea-island fibers having an average cross-sectional area of 940 μm$^2$ (about 9.8 dtex). The obtained sea-island fibers were drawn by 3.0 times, crimped, and then cut into staples having a fiber length of 51 mm. The staples were carded by a carding machine and lapped by a cross lapper to obtain a short fiber web. The obtained short fiber webs were superposed and thereafter a substrate for artificial leathers was produced by following the steps of Example 1. The obtained substrate for artificial leathers was made into a nubuck artificial leather in the same manner as in Example 2. The nubuck artificial leather had a suede appearance with a relatively rough raised appearance and was quite different from the raised artificial leather obtained in Example 2. Although the color development was good, the writing effect was poor because the surface was less densified, the hand was hard, and the pilling resistance was poor. The obtained nubuck artificial leather failed to satisfy the levels aimed in the present invention in other properties. The evaluation results are shown in Table 1.

COMPARATIVE EXAMPLE 3

A mixture of nylon 6 (island component) and a low density polyethylene (sea component) in a sea component/island component of 50/50 was melted. The molten polymer was fed into a spinneret having a number of nozzles arranged concentrically and extruded from the nozzles at a spinneret temperature of 290° C. The extruded polymers were made thinner by pulling while bringing them together, to mix-spin the sea-island fibers having an average cross-sectional area of 940 μm$^2$ (about 9.5 dtex). On the cross section of the span sea-island fibers, thousands of islands made of nylon 6 were scattered in the sea component of polyethylene. The obtained sea-island fibers were drawn by 3.0 times, crimped, and then cut into staples having a fiber length of 51 mm. The staples were carded by a carding machine and lapped by a cross lapper to obtain a short fiber web. The obtained short fiber webs were superposed and thereafter a substrate for artificial leathers was produced by following the steps of Example 1. The obtained substrate for artificial leathers was made into a nubuck artificial leather in the same manner as in Example 2. The surface denseness of the obtained nubuck artificial leather was rather acceptable and the nubuck appearance was close to that of Example 2. However, the color development was poor and the hand was paper-like and hard. The obtained nubuck artificial leather failed to satisfy the levels aimed in the present invention in other properties. The evaluation results are shown in Table 1.

COMPARATIVE EXAMPLE 4

A substrate for artificial leathers was produced in the same manner as in Example 1 except for changing the conditions of the entangling treatment by needle punching as follows.

Prior to the entangling treatment using a general needle-punching machine, the long fiber web was first needle-punched using needles D having barbs with 60 μm deep at equidistance from the tip of the blade portion and on the apexes of the regular triangle cross section. The long fiber web was conveyed by a brush belt and needle-punched from the side opposite to the brush belt in a punching density of 500 punch/cm$^2$ in a punching depth allowing 3 barbs to penetrate through the web in the thickness direction, thereby strongly entangling the sea-island fibers in the thickness direction.

The obtained substrate for artificial leathers was made into a nubuck artificial leather in the same manner as in Example 2. The number of cross sections of microfine fiber bundles existing in unit area of a cross section parallel to the thickness direction of the nubuck artificial leather was about 800/mm$^2$ in average at the densified area. However, the areas in which 15 to 50 fiber bundles were oriented toward the thickness direction, i.e., the areas in which the existence density of the cross sections of microfine fiber bundles was form about 0 to 50/mm$^2$ existed throughout the cross section with intervals of about 100 to 500 μm in the width direction. Therefore, the overall average existence density throughout the cross section was about 450/cm$^2$. Although the color development and surface abrasion resistance were good, the appearance and hand of the nubuck artificial leather failed to reach the levels aimed in the present invention. The evaluation results are shown in Table 1.

TABLE 1

| | Examples | | Comparative Examples | | | |
|---|---|---|---|---|---|---|
| | 2 | 4 | 1 | 2 | 3 | 4 |
| Microfine fibers | | | | | | |
| kind | long fiber | long fiber | long fiber | staple | staple | long fiber |
| cross-sectional area (μm$^2$) | 2.6 | 2.6 | 5.3 | 4.5 | 0.062 | 2.6 |
| Microfine fiber bundles | | | | | | |
| cross-sectional area (μm$^2$) | 68 | 68 | 142 | 234 | 181 | 68 |
| existence density (per mm$^2$) | 1500 | 1950 | 900 | 350 | 650 | 450 |
| Color development | A | A | A | A | C | A |
| Appearance | A | A | C | C | B | C |
| Hand | A | A | B | C | C | C |
| Surface abrasion resistance | A | A | A | C | A | A |
| abrasion loss (mg) | 2 | 1 | 14 | 65 | 47 | 1 |
| piling | A | A | B | C | A | A |

Example 5

The substrate for artificial leathers obtained in Example 3 was buffed on both surfaces by sandpaper to regulate the thickness to 0.9 mm and smoothen the surfaces. One of the surfaces was further smoothened by treating with a mirror roll at 160° C. The treated surface was used as the top surface in the subsequent stages. Separately, a surface cover layer with a thickness of 15 μm was formed on a grained release paper using a brown-dyed polyurethane composition mainly composed of a polycarbonate-based polyurethane. Then, an adhesive layer of a polyurethane adhesive containing a cross-linking agent was formed on the surface cover layer. The two-layered film thus formed was bonded to the top surface of the substrate for artificial leathers via the adhesive layer. After ageing treatment at ambient temperature of 65° C. for 3 days, the release paper was peeled off. Then, after relaxing in a warm water bath at 70° C. containing a surfactant and a softening agent for 30 min using a washer, an inventive grain-finished artificial leather was obtained. The number of cross sections of microfine fiber bundles existing in unit area of a cross section parallel to the thickness direction of the grain-finished artificial leather was about 1840/mm$^2$ in average, showing that the denseness was extremely high. In addition, the appearance, hand and bonding/peeling strength were all excellent. Thus, the obtained grain-finished artificial leather exhibited the effects aimed in the present invention. The evaluation results are shown in Table 2.

COMPARATIVE EXAMPLE 5

A substrate for artificial leathers was produced in the same manner as in Example 3 except for using split/division-type fibers in place of sea-island fibers, changing the conditions for entangling treatment, and changing the method of converting to microfine fibers.

The long fiber web was produced from split/division-type fibers having an average cross-sectional area of 240 μm$^2$ (about 3.0 dtex). The split/division-type fibers had a 16-segment cross section in which 8 segments of the nylon 6 component and 8 segments of the polyethylene terephthalate (PET) component, the segments having nearly the same cross-sectional area, were alternately arranged to form a petaline cross section.

In the needle punching treatment, the needles E having 9 barbs with a barb depth of 80 μm were used in place of the needles A and B. The needle punching was performed from both sides in a punching density of 1000 punch/cm$^2$ in total at a punching depth (about 8 mm) for allowing the third barb from the tip of needle to penetrate through the web in its thickness direction. The web was then subjected to a shrinking treatment by immersing in a warm water bath at 90° C. for 90 s, and then subjected to, without pressing, a water jet treatment from both side at a water pressure of 150 kg/cm$^2$.

In place of removing the sea component by extraction, about 10% of PET component was removed by the alkaline liquid treatment using an aqueous solution of sodium hydroxide.

The obtained substrate for artificial leathers was observed under an electron microscope on its surface and a cross section parallel to the thickness direction thereof. Although the surface was basically made of a long-fiber nonwoven fabric, broken fibers existed in a density as extremely large as 5 to 10/mm$^2$. In addition, the areas in which 15 to 70 fiber bundles were oriented toward the thickness direction existed throughout the cross section with intervals of about 0.6 to 1.3 mm in the width direction. Then, the obtained substrate for artificial leathers was made into a grain-finished artificial leather in the same manner as in Example 5. The appearance of the obtained grain-finished artificial leather was apparently the same as that obtained in Example 5. However, the number of cross sections of microfine fiber bundles existing in unit area of a cross section parallel to the thickness direction of the substrate was as extremely small as about 330/mm$^2$ in average. In addition, most part of the fibers did not divided into microfine fibers, and the microfine fiber bundles divided and the microfine fiber bundles almost not divided adhered to the elastic polymer in places. Further, the obtained grain-finished artificial leather completely failed to satisfy the levels aimed in the present invention in other properties. The evaluation results are shown in Table 2.

TABLE 2

| | Example 5 | Comparative Example 5 |
|---|---|---|
| Composite fibers | | |
| cross-sectional shape | sea-island | petaline |
| Microfine fibers | | |
| cross-sectional area (μm$^2$) | 2.6 | 28.5 |
| Microfine fiber bundles | | |
| cross-sectional area (μm$^2$) | 68 | 232 |
| existence density (per mm$^2$) | 1840 | 330 |

TABLE 2-continued

| | Example 5 | Comparative Example 5 |
|---|---|---|
| Appearance | A | B |
| Hand | A | C |
| Bonding/peeling strength | A | C |
| length direction (kg/cm) | 4.2 | 2.1 |
| width direction (kg/cm) | 4.4 | 1.8 |

INDUSTRIAL APPLICABILITY

The nubuck artificial leathers made from the substrate for artificial leathers of the present invention have a raised appearance with an extremely high denseness which resembles those of natural nubuck leathers. The nubuck artificial leathers are good in the color development and in the properties such as a soft hand with fullness combined with denseness and the surface abrasion resistance such as pilling resistance which are hitherto difficult to be combined. The grain-finished artificial leathers made from the substrate for artificial leathers of the present invention have a highly smooth, natural leather-like grain appearance having fine buckling grains. The grain-finished artificial leathers are also excellent in the properties such as the uniformity of the substrate and grain layer, soft hand with fullness and bonding/peeling strength which are hitherto difficult to be combined. These artificial leathers are suitable in the applications such as clothes, shoes, bags, furniture, car seats and sport gloves such as golf gloves.

What is claimed is:

1. A substrate comprising a nonwoven fabric body made of microfine fiber bundles and an elastic polymer impregnated therein, which simultaneously satisfies the following requirements 1 to 4:

(1) each of the microfine fiber bundles comprises 6 to 150 bundled microfine long fibers in average;

(2) a cross-sectional area of the microfine long fibers constituting the microfine fiber bundles is 27 $\mu m^2$ or less, and 80% or more of the microfine long fibers has a cross-sectional area of from 0.9 to 25 $\mu m^2$;

(3) an average cross-sectional area of the microfine fiber bundles is from 15 to 150 $\mu m^2$; and (4) on a cross section parallel to a thickness direction of the nonwoven fabric body, cross sections of the microfine fiber bundles exist in a density of from 1000 to 3000/$mm^2$ in average.

2. The substrate according to claim 1, wherein each of the microfine fiber bundles comprises 6 to 90 bundled microfine long fibers in average.

3. The substrate according to claim 1, wherein each of the microfine fiber bundles comprises 10 to 40 bundled microfine long fibers in average.

4. A raised artificial leather which comprises the substrate as defined in any one of claims 1, 2, and 3, wherein raised fibers comprising microfine fibers are formed on at least one surface of the substrate.

5. A grain-finished artificial leather which comprises the substrate as defined in any one of claims 1, 2, and 3, wherein a cover layer comprising an elastic polymer is formed on at least one surface of the substrate.

6. A method of producing a substrate which comprises the following (a), (b), (c) and (d) in this order, or the following (a), (b), (d) and (c) in this order:

(a) melt-spinning sea-island fibers having an average island number of 6 to 150, a ratio of an average sea cross-sectional area and an average island cross-sectional area of 5:95 to 70:30, and an average cross-sectional area of 30 to 180 $\mu m^2$, and then, colleting the sea-island fibers in random directions on a collecting surface without cutting, thereby obtaining a long fiber web;

(b) entangling the sea-island fibers three-dimensionally by needle-punching the long fiber web from both surfaces thereof so as to allow at least one barb to penetrate through the long fiber web optionally after superposing two or more long fiber webs, and then, optionally shrinking or heat-pressing the needle-punched long fiber web for densification and/or fixation, thereby obtaining a nonwoven fabric body in which cross sections of the sea-island fibers exist on a cross section parallel to a thickness direction of the nonwoven fabric body in a density of from 600 to 4000/$mm^2$ in average;

(c) impregnating a solution of an elastic polymer into the nonwoven fabric body and coagulating the elastic polymer by a wet method; and (d) removing a sea component polymer from the sea-island fibers constituting the nonwoven fabric body by extraction or decomposition, thereby converting the sea-island fibers to microfine fiber bundles.

7. The substrate according to claim 1, 2, or 3, wherein the impregnated elastic polymer does not adhere to the microfine fiber bundles.

8. The substrate according to claim 1, 2, or 3, wherein the average cross-sectional area of the microfine fiber bundles is from 30 to 120 $\mu m^2$.

9. The substrate according to claim 1, 2, or 3, wherein the average cross-sectional area of the microfine fiber bundles is from 40 to 100 $\mu m^2$.

10. The method according to claim 6, wherein the polymer for the island component of the sea-island fibers is one of polyethylene terephthalate (PET), polytrimethylene terephthalate (PTT), polybutylene terephthalate (PBT), nylon 6, nylon 66, nylon 610, nylon 12, aromatic polyamide, semi-aromatic polyamide, polypropylene, polyester-based polyurethane, apolyester elastomer, or a polyamide elastomer.

11. The method according to claim 6, wherein the substrate produced by said method comprises a nonwoven fabric body made of microfine fiber bundles and an elastic polymer impregnated therein, and wherein the produced substrate simultaneously satisfies the following requirements 1 to 4:

(1) each of the microfine fiber bundles comprises 6 to 150 bundled microfine long fibers in average;

(2) a cross-sectional area of the microfine long fibers constituting the microfine fiber bundles is 27 $\mu m^2$ or less, and 80% or more of the microfine long fibers has a cross-sectional area of from 0.9 to 25 $\mu m^2$;

(3) an average cross-sectional area of the microfine fiber bundles is from 15 to 150 $\mu m^2$; and (4) on a cross section parallel to a thickness direction of the nonwoven fabric body, cross sections of the microfine fiber bundles exist in a density of from 1000 to 3000/$mm^2$ in average.

* * * * *